United States Patent [19]

Jansson

[11] 3,973,562

[45] Aug. 10, 1976

[54] MULTI-USER EXTENDED OPERATION RESPIRATOR

[76] Inventor: David Guild Jansson, 85 Pond St., Natick, Mass. 01760

[22] Filed: July 29, 1974

[21] Appl. No.: 492,719

[52] U.S. Cl. ..... 128/142 R; 128/191 R; 128/202

[51] Int. Cl.[2] ..... A62B 7/02

[58] Field of Search ..... 128/191 R, 202, 203, 128/142 R, 142.2, 142.3, 145.5, 145.8, 188, 145.6

[56] References Cited

UNITED STATES PATENTS

| | | | |
|---|---|---|---|
| 1,370,590 | 3/1921 | Kamieniecki | 128/142.3 |
| 2,332,662 | 10/1943 | Nathanson | 128/142.3 |
| 3,016,053 | 1/1962 | Medovick | 128/142 |
| 3,219,034 | 11/1965 | Kalenik | 128/142 |
| 3,575,167 | 4/1971 | Michielsen | 128/142.2 |
| 3,577,988 | 5/1971 | Jones | 128/191 R |
| 3,722,510 | 3/1973 | Parker | 128/142 |
| 3,805,590 | 4/1974 | Ringwall et al. | 128/142 |
| 3,815,592 | 6/1974 | Staub, Jr. | 128/191 R |

FOREIGN PATENTS OR APPLICATIONS

| | | | |
|---|---|---|---|
| 216,459 | 5/1924 | United Kingdom | 128/191 R |

*Primary Examiner*—Robert W. Michell
*Assistant Examiner*—Henry J. Recla

[57] ABSTRACT

A respiratory protective device is disclosed. The device is of a type which may be used by several persons for an extended length of time in a noxious environment. The invention is characterized by a source of oxygen-rich gas, a breathing bag means, a valving system to vent and replenish the breathing bag means, a breathing conduit loop having inhalation and exhalation manifolds and a means therebetween to deliver breathable gas to several users at the same time, and a scrubber to remove carbon dioxide from exhaled gas. Special features include a unique dual alternately active breathing bag means and an assist means for movement of exhaled gas through the scrubber.

8 Claims, 3 Drawing Figures

MULTI-USER EXTENDED OPERATION RESPIRATOR

BACKGROUND OF THE INVENTION

This invention relates to the field of breathing apparatus and particularly relates to respiratory protective systems such as may be used after some emergency situation has caused a noxious environment.

For example, this invention may be used as a mine catastrophe respirator system. This invention will be described with particular reference to systems usable by miners. However, it is to be understood that this invention is applicable to other fields where extended use for protection from noxious environments may be necessary. The description in terms of miners' equipment and problems is merely for purposes of illustration.

There are three significant reasons which justify the need for respiratory protection of the type given by this invention. The presence of elevated levels of noxious gases which may be present in a mine following some sort of disaster, including deadly carbon monoxide if there has been a fire, is an immediate hazard to trapped miners. Furthermore, trapped miners, especially if there has been a fire, suffer from a reduced oxygen supply. Therefore, oxygen must be supplied along with protection from the noxious constituents of the surrounding atmosphere. Thirdly, if oxygen is to be supplied for periods longer than 2 or 3 hours, the respiratory protective device used must be of a type which controls the oxygen concentration of the gas which is breathed. Too high a concentration of oxygen breathed for long periods of time causes hypoxia. Therefore, the supply of gas must also include another gas, such as nitrogen, to ensure that, even in the presence of leaks from the system, the oxygen concentration can be controlled.

A significant economic and logistic savings can be realized if one device to be used in emergency situations can be kept near a small group of miners instead of giving each miner his own device. Such a device should be capable of supplying, for example, about five or six miners with a 2-day supply of breathable gas for a period during which they await rescue. This would require a supply of 10 or 12 man-days of breathable gas.

Respirator systems of the prior art which supply oxygen and protect the user from a noxious environment are of two basic types. One is a compressed air system and the other is an oxygen rebreather system.

A compressed air system consists of a compressed air tank with a demand regulator which provides air to a mask during inhalation. The major problem of a system of this type is that the immense volume and weight of the supply tank which would be required for extended use prohibits the use of such a system for such applications.

An oxygen rebreather system includes a significantly smaller tank containing pure oxygen. Pure oxygen is supplied to a breathing bag and a scrubber removes carbon dioxide from the exhaled gas. Some nitrogen is present in the bag at the beginning of use but system leaks soon drive the oxygen concentration of the gas in the bag to near 100 percent. Prolonged use of a respirator prohibits the use of a standard oxygen rebreather system for such applications because of the aforementioned hypoxia.

BRIEF SUMMARY OF THE INVENTION

The new respirator system provides a number of users with breathable gas, which contains a controlled amount of oxygen, for long periods of time, allowing, for example, rescuers a sufficiently long period of time to locate and rescue trapped miners. The system is portable to the extent that it is of a size allowing ready moving, either by carrying, or by other means such as by pulling on wheels. The device may be moved easily by a miner or a mine vehicle, so that it may be kept near a group of miners at all times.

The respirator of my invention includes a source of oxygen-rich gas, a breathing bag means, a valving system to vent and replenish the breathing bag means, a device such as a sensor to determine the oxygen concentration of the gas in the breathing bag means, a scrubber to remove carbon dioxide from exhaled gas, and a breathing conduit loop having inhalation and exhalation manifolds and means to deliver the breathable gas to several users at the same time.

A unique means to assist movement of exhaled gas through the scrubber is used in some embodiments of this invention. This assist means includes a gas-moving means within the breathing conduit loop adjacent to the scrubber, and a bypass conduit bypassing the scrubber and gas-moving means and having check valve means therein preventing exhaled gas from bypassing the scrubber in a downstream direction but allowing upstream flow. This device assists exhalation through a scrubber having a significant breathing impedance.

Certain inventive systems described herein include a unique breathing bag means which provides excellent operation in a self-contained, portable, extended use, multiple-user respirator. This means includes a vented chamber of substantially fixed volume and first and second alternately active, compliant breathing bags therein, each of which has a filled volume within the chamber substantially equal to the volume of the chamber. The operation of a system with this breathing bag means will be described in detail hereinafter. This preferred breathing bag means is the subject of a copending, concurrently filed patent application of the same inventor. The alternately-active breathing bags physically interact within the chamber. As one is replenished from the source, the other is vented to the atmosphere by bag interaction.

The frequent venting and replenishment of small amounts of gas in the breathing bag means permits the system to operate at lower and safer peak levels of oxygen concentration. Thus it is highly preferred, in a system having the aforementioned alternately-active breathing bag means, to design the system to allow replenishment of the activated bag by a quantity of gas less than the filled volume of the bag.

The system of this invention embraces the idea of rebreathing oxygen-rich gas from a breathing bag until the gas has a concentration of oxygen low enough to necessitate discarding the gas. Some of this old gas is then vented to the atmosphere, and a fresh volume of gas is supplied. Each breath lowers the concentration of oxygen until a lower limit is reached. If venting and replenishment are done often using small volumes of gas, the oxygen concentration of the gas in the breathing bag means can be controlled under a sufficiently low upper limit to prevent hypoxia while requiring the oxygen-rich source of gas to contain only a very small amount of gas such as nitrogen (for example 5–10 percent). This high concentration of oxygen in the source translates into a huge volume savings and prolongs the length of operation of the system.

The advantages of this respirator are that it provides, for several persons, breathable gas with a physiologically acceptable oxygen concentration, for a long period of time. The device is self-contained, readily portable (on its own wheels or otherwise), and able to sit idle for very long periods of time until it is needed.

A primary object of this invention, therefore, is to provide a respirator system which will operate for very long periods of time without replenishment of the source of breathing gas.

Another object of this invention is to provide a respirator which will provide protection for several users at the same time.

A further object of this invention is to provide a respirator which operates at a physiologically safe level of oxygen concentration.

Still another object of this invention is to provide a respirator which meets all the above requirements but is still of reasonably small size and weight so that it is readily portable, such as on wheels.

These and other important objects of the invention will become apparent from the following description and drawings showing preferred embodiments of the invention.

DETAILED DESCRIPTION OF A PREFERRED EMBODIMENT

Throughout the figures, like numerals are used for identification of like elements and parts.

Figure 1:
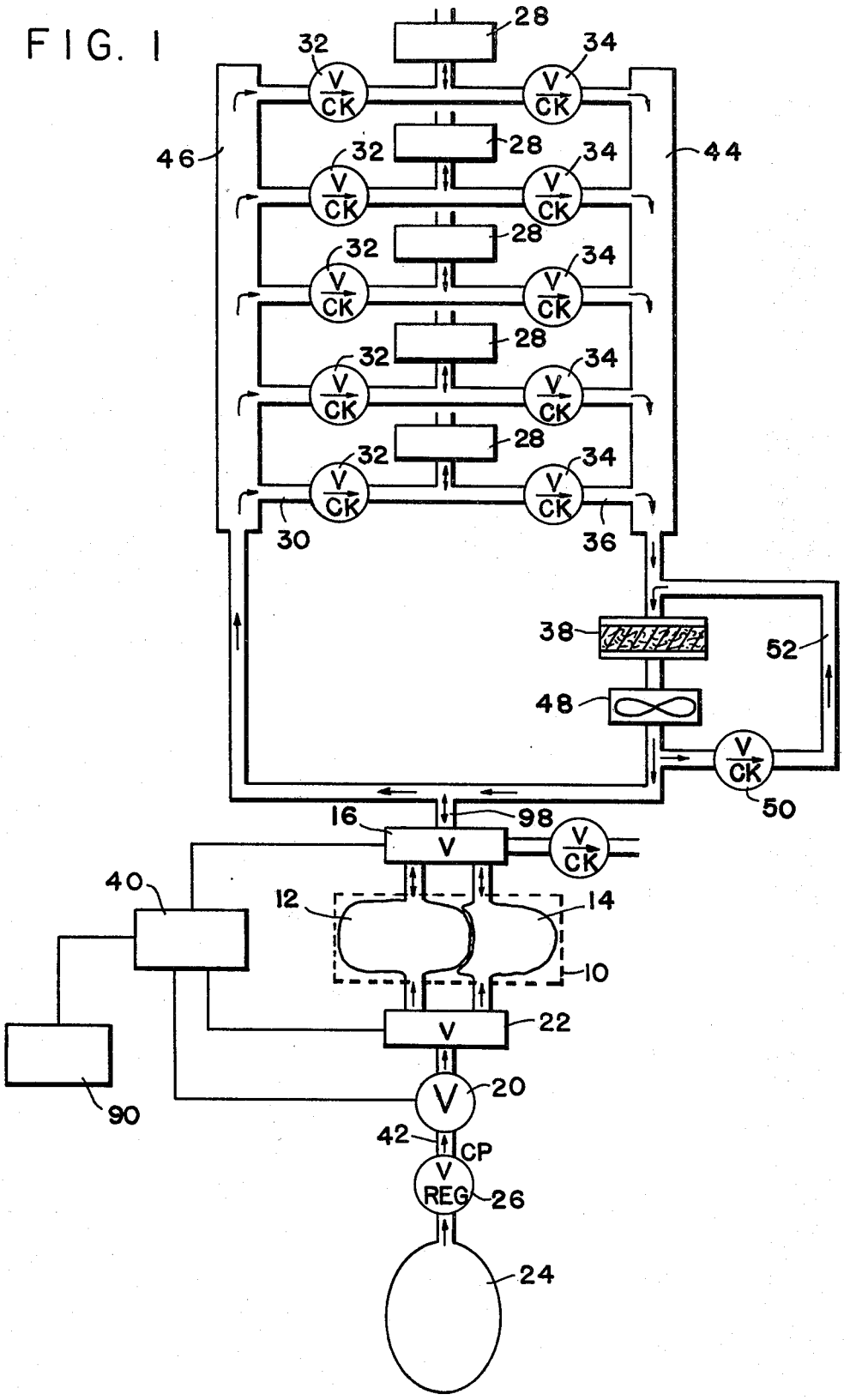
FIG. 1 is a functional schematic of a preferred respirator system according to this invention.

A preferred embodiment of this invention is illustrated by the schematic drawing of FIG. 1. The respirator of FIG. 1 includes a vented bag chamber 10 having a substantially fixed volume. The chamber has walls through which the surrounding atmosphere can pass freely. An example of the type of material out of which the walls are made is common window screen. However, any material having sufficient strength and enough holes over a major portion of the chamber to allow free passage of the surrounding atmosphere is suitable for construction of chamber 10. Bag chamber 10 houses breathing bags 12 and 14. The volume of the bags 12 and 14 is constrained by the chamber 10 so that when either bag is full its volume is substantially equal to the volume of chamber 10. "Substantially equal" does not necessarily imply close to 100 percent of chamber volume, though this is preferred. The term, however, does imply enough filled volume for bag interaction, as further explained hereafter.

Breathing bags 12 and 14 are extremely compliant, meaning that adding gas to increase the volume of the bags does not increase the pressure of the gas in the bags. (Mathematically, $dP/dV$ is equal to or very close to zero, where $dP/dV$ is the derivative of the gas pressure in the bag with respect to the volume of the bag.) Examples of materials that can be used for breathing bags are neoprene sheeting and common polyethylene sheeting. Other suitable materials will be obvious to those skilled in the art to whom this invention has been disclosed. Chamber 10 constrains bags 12 and 14 in a way such that if bag 12 is filled with gas, the filling process will force the gas in bag 14 to be expelled, and vice versa. Chamber 10 and bags 12 and 14 constitute the breathing bag means in this embodiment.

Bags 12 and 14 are connected to tank 24, which contains a compressed supply of oxygen-rich gas, through valve means 22, valve 20, and constant pressure regulator 26. Valve means 22 can be switched into two modes, either connecting bag 12 to valve 20 or connecting bag 14 to valve 20. Valve 20 is open for a short period of time to allow gas from tank 24 through regulator 26 to fill one of the breathing bags. Control of valve means 22 and valve 20 is accomplished by a controller 40 and power source 90. Valve means 22, valve 20, and the control means form a means to open the source of breathing gas (tank 24) to alternately fill bags 12 and 14 with a quantity of breathing gas. The detailed description of the function of controller 40 will be given hereinafter.

The respirator of FIG. 1 further includes a breathing conduit loop having an inhalation manifold 46, a multiplicity of breathing conduits 30, inhalation check valves 32, masks 28 for delivery of the gas to the users, exhalation check valves 34, breathing conduits 36, an exhalation manifold 44, a chemical scrubber 38, a gas-moving means 48 (such as a fan), a bypass conduit 52, a bypass conduit check valve 50, and a valve means 16 to which both bags are connected. Each mask 28, with check valves 32 and 34 and conduits 30 and 36, form a breathing station in fluid communication with both manifolds 44 and 46. Means for delivery of the gas to the users can also be mouthpieces, complete helmets, or other suitable devices in place of masks 28.

Valve means 16 can be switched into two modes, either connecting bag 12 into the breathing conduit loop and bag 14 to the atmosphere through check valve 18 or connecting bag 14 into the breathing conduit loop and bag 12 to the atmosphere through check valve 18. Valve means 16, check valve 18, and the control means form a means to alternately vent bags 12 and 14 as the activated bag is being filled. Therefore, breathing gas is fed to and from masks 28 from either bag 12 or bag 14 by the breathing conduit loop. Like valve means 22 and 20, valve means 16 is controlled by controller 40, described hereinafter. Valve means 16 and the control means form a means to alternately activate bags 12 and 14 for breathing. Controller 40, power source 90, and valves 16, 20 and 22 form the means to replenish the breathing bag means in this embodiment.

The control means in this particular embodiment of the respirator of FIG. 1 contains a battery power supply 90, electronic circuitry in controller 40, and microswitches located in valve means 16 and 22. Details of a suitable control means will be obvious to a man skilled in the art to whom this invention has been disclosed. A wide variety of control means, including various types of apparatus, are suitable for use in this invention and such would be obvious. The control means also includes a means of determining the oxygen concentration in the breathing conduit loop, that is, a means to determine when the concentration of oxygen is at a predetermined lowest tolerable level. This means may be an oxygen sensor. Methods and means to determine the oxygen concentration of the gas in the breathing conduit loop would be obvious to someone skilled in the art to whom this invention has been disclosed.

A typical cycle of operation of the respirator of FIG. 1 is as follows. For this discussion, a single breathing station will be used to describe the operation of the respirator. The addition of several such station does not alter this cycle of operation of the system. The activated bag 12 contains oxygen-rich gas just after being filled. Bag 12 is, therefore, connected by valve means 16 to mask 28 by the breathing conduit loop. Valve means 16, while placing the activated bag 12 in the breathing conduit loop, also connects the deactivated bag 14 to the surrounding atmosphere through check valve 18 which allows gas to pass only from the deactivated bag 14 to the atmosphere.

A user, wearing mask 28, inhales gas from bag 12 and exhales gas through scrubber 38 back into bag 12. The operation of the gas-moving means 48, bypass conduit 52, and check valve 50 will be explained hereinafter. The purpose of these additional components is to lower the impedance to breathing of the scrubber and, as such, they do not change the description of the cycle of operation.

The concentration of oxygen in bag 12 is lowered with each breath. Scrubber 38 chemically removes the carbon dioxide from the exhaled gas. The oxygen sensor determines when the concentration of oxygen has reached a predetermined lowest tolerable level, and at such time controller 40 begins the switching sequence which deactivates bag 12, activates bag 14, fills bag 14, and allows venting of bag 12 through check valve 18. When the controller 40 starts the switching sequence, valve means 16 places bag 14 into the breathing conduit loop and connects bag 12 to the atmosphere through check valve 18. Thus bag 12 and bag 14 have switched roles, bag 14 now being the activated bag and bag 12 the deactivated bag.

Since the end of the previous switching sequence, valve 22 has been in a mode connecting valve 20 to bag 14. Immediately after the change of valve means 16, the controller 40 activates valve 20 for a preset short interval of time to allow a supply of oxygen-rich gas to pass from tank 24 through regulator 26, valve 22 and valve 22 into the newly activated bag 14. The filling of bag 14 causes the expansion of bag 14 in the chamber 10, thus causing the contraction of bag 12 in the chamber 10 by the physical interaction of bags 12 and 14, expelling the gas in bag 12 through check valve 18 to the atmosphere. If the volume of the newly filled activated bag 14 is less than the volume of the chamber 10, then some of the gas in bag 12 will remain to be used after the next switching sequence which will activate bag 12 and deactivate bag 14. When the controller 40 closes valve 20, controller 40 then activates valve 22 which changes to the mode connecting valve 20 to bag 12, ready for the next switching sequence. The user now breathes from the activated bag 14 in the breathing conduit loop and the oxygen sensor measures the oxygen concentration of the gas in bag 14. This concentration decreases with each breath until the oxygen sensor measures the predetermined level, at which point the switching sequence reverses the roles of bag 12 and bag 14 again, filling the newly activated bag 12 and expelling gas from bag 14 in the same manner as the switching sequence described above. Similarly, valve 22 now switches to a mode connecting bag 14 to valve 20 for filling of bag 14 during the next switching sequence. The respirator continues to operate through repetitive cycles during the entire period of use, thus making very efficient use of the oxygen contained in supply source 24, while keeping a low oxygen concentration in the gas breathed from the breathing conduit loop.

The gas-moving means 48, hereinafter referred to as fan 48, is placed in the breathing conduit loop adjacent to the scrubber 38 to assist the users in exhaling through the high resistance of the scrubber 38. The scrubber 38 is necessarily large because of the extended operation of the respirator. It is difficult to geometrically arrange the large amounts of scrubber chemical in a low flow resistance configuration. Further, the work required to push the exhaled gas through the scrubber 38 by the users becomes an added drain on the oxygen supply of the system. A low-powered fan or other gas-moving device is, therefore, used to assist flow of exhaled gas through the scrubber. Such device significantly lowers exhalation impedance and increases the operating time of the system. Bypass conduit 52 and check valve 50 are included in the loop as shown in FIG. 1 so that the pressure in the exhalation manifold 44 will not be so low as to create a hardship on the users during inhalation. During inhalation, gas flows around the loop from fan 48 through check valve 50, conduit 52 and through scrubber 38 and fan 48. A small amount of gas also flows around the breathing conduit loop, not affecting breathing at all. During exhalation, the increased pressure in the exhalation manifold 44 causes the fan 48 to drive exhaled gas into the activated breathing bag. Check valve 50 is used to prevent flow from bypassing the scrubber 38.

Figure 2:
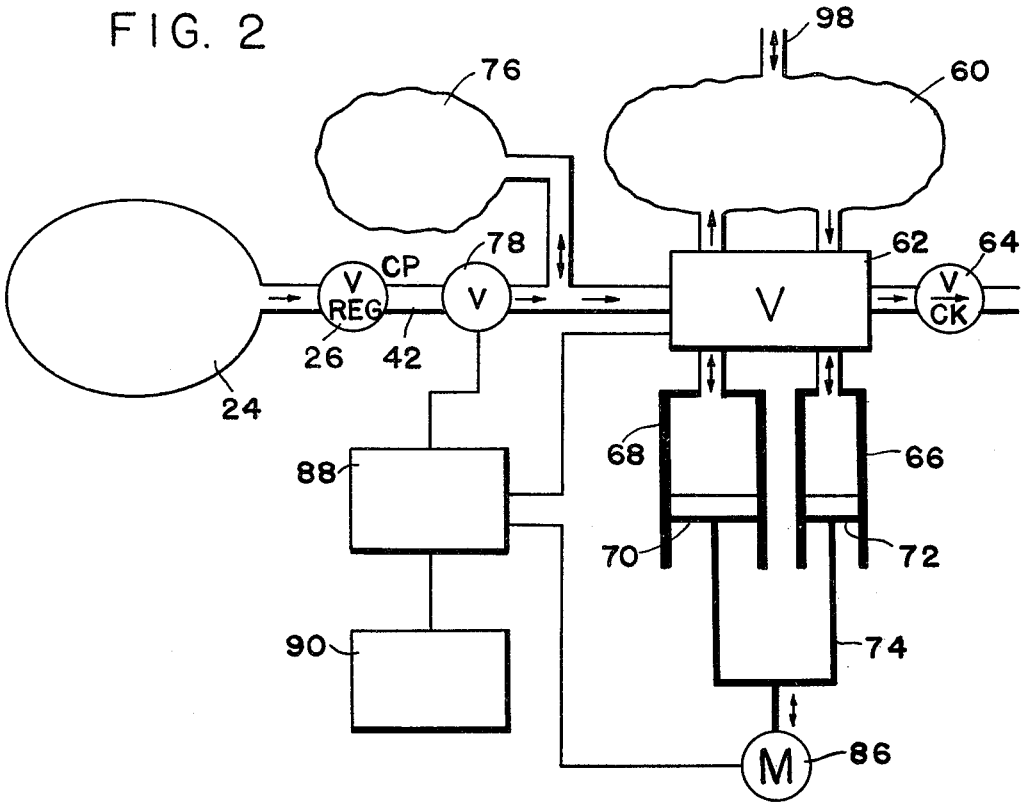
FIG. 2 is a functional schematic of a portion of another embodiment of this invention.

FIG. 2 is a functional schematic of a portion of another embodiment of this invention. The breathing conduit loop is identical to that of FIG. 1 and is not shown in FIG. 2. The alternate embodiment of FIG. 2 connects with the breathing conduit loop of FIG. 1 at point 98, shown in both figures. A single breathing bag 60 is used in this embodiment. Bag 60 is connected to tank 24, which contains a compressed supply of oxygen-rich gas, through valve means 62, valve 78, and constant pressure regulator 26. A small, highly compliant bag 76 is connected downstream of valve 78. Two cylinders are also connected to valve means 22, a replenishment cylinder 68 with piston 70 and a venting cylinder 66 with piston 72. Pistons 70 and 72 are mechanically linked to each other and to driver 86 by linkage 74. The volume of the venting cylinder 66 is smaller than that of replenishment cylinder 68. The difference in the volumes of these cylinders is determined by the oxygen concentration of the supply and the lowest tolerable level of oxygen concentration. To maintain the proper volume of breathing gas in the bag 60, the amount of gas other than oxygen added during a replenishment cycle must be substantially equal to the amount of such gases vented during that cycle. Valve means 62 can be switched into two modes, either connecting bag 60 to cylinder 66 and bag 76 to cylinder 68, or connecting cylinder 66 to the atmosphere through check valve 64 and cylinder 68 to bag 60. Power source 90 and controller 88 form a control means which controls the operation of valve 78, valve means 62, and driver 86. A detailed description of the function of the control means will be given hereinafter.

Materials used in the fabrication of bags 60 and 76 can be similar to those mentioned herein for the fabrication of bags 12 and 14. Driver 86, in this embodiment, is any mechanical device, such as a motor or solenoid, which translates a signal from controller 88 into motion to displace the pistons 70 and 72 in the cylinders 68 and 66. Details of the various means to accomplish such function will be obvious to those skilled in the art to whom this invention has been disclosed.

A typical cycle of operation of the respirator of FIG. 2 is as follows. For this discussion, the venting and replenishment of bag 60 will be detailed. The details of the breathing conduit loop supplied by the bag 60 are similar to the description given heretofore. When the oxygen sensor, part of controller 88, indicates that the oxygen concentration in bag 60 has reached the lowest tolerable level, the switching sequence begins. At this point, bag 76 is approximately full of gas from source 24, at a pressure near that of the surrounding atmosphere, the pistons 70 and 72 are in the position such that the volumes of the cylinders 68 and 66 are at a minimum, and valve means 62 is in the mode connecting cylinder 68 to bag 60 and cylinder 66 to the atmosphere through check valve 64. Valve means 62 is switched by the control means to the mode connecting cylinder 68 to bag 76 and cylinder 66 to bag 60. The driver 86 then moves pistons 70 and 72 by linkage 74 to the position such that the volumes of the cylinders 68 and 66 are at a maximum. This motion draws volumes of gas at the pressure of the surrounding atmosphere into cylinder 68 from bag 76 and into cylinder 66 from bag 60. Thus the gas in cylinder 66 has been removed from bag 60. The control means now switches valve means 62 into the mode connecting cylinder 68 to bag 60 and cylinder 66 to the atmosphere through check valve 64. After this switch of valve means 62, the driver 86 moves the pistons 70 and 72 back to the position of minimum volumes of the cylinders 68 and 66. This motion drives the supply gas in cylinder 68 into bag 60, thus replenishing bag 60, and drives the gas in cylinder 66 through check valve 64 to the surrounding atmosphere, thus venting the "old" gas. With valve means 62 in this mode, the control means opens valve 78 for a specified interval of time, supplying a volume of gas to bag 76. The respirator is now ready for the next switching sequence to begin when the oxygen sensor in controller 88 determines that the oxygen concentration of the gas in bag 60 is again at the lowest tolerable level. The respirator continues to operate through repetitive cycles during the entire period of use, thus making very efficient use of the oxygen contained in supply source 24, while keeping a low oxygen concentration in the gas breathed from the breathing conduit loop.

Bag 76 is used to ensure that the volume of fresh gas supplied to cylinder 68 is at the pressure of the surrounding atmosphere to prevent over-filling of bag 60. Other means to ensure such a pressure in cylinder 68 will be obvious to those skilled in the art to whom this invention is disclosed.

Figure 3:
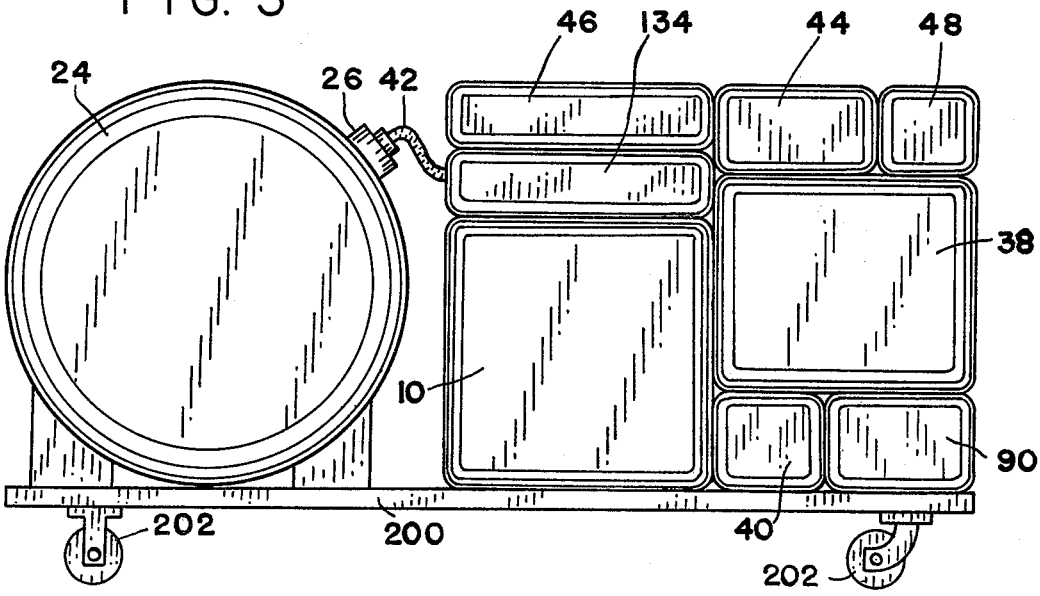
FIG. 3 is a side elevation view illustrating the compactness of a preferred embodiment of this invention.

FIG. 3 shows an arrangement of the components of the respirator of FIG. 1 to illustrate how this preferred embodiment may be placed on a base 200 with wheels 202. Valve means 16 and 22, valve 20 and check valve 18 are shown contained in a single valve package 134 above chamber 10. Manifolds 44 and 46 and gas moving means 48 are contiguous with valve package 134 and scrubber 38. Power source 90 and controller 40 are placed under scrubber 38. The fluid and electrical connections are all internal except for the high pressure conduit 42 from regulator 26 to valve package 134. The breathing stations (not shown) are connected to the manifolds 44 and 46. The components of the respirator of this invention may be placed in a compact, low-profile arrangement, easily mounted on a movable base. Other compact or distributed arrangements of the components of the respirator of this invention would be obvious to those skilled in the art to whom this invention has been disclosed.

Various materials useful in the components of embodiments of this invention will be apparent to those skilled in the art to whom this invention has been disclosed.

While in the foregoing specification this invention has been described in relation to certain preferred embodiments, and many details have been set forth for purpose of illustration, it will be apparent to those skilled in the art that the invention is susceptible to additional embodiments and that certain of the details described herein can be varied considerably without departing from the spirit of the invention.

I claim:

1. A self-contained, multiple-user respirator system comprising:

a source of compressed oxygen-rich gas;

a single breathing bag means;

a breathing conduit loop including said breathing bag means, an inhalation manifold in fluid communication with said breathing bag means, a scrubber to remove carbon dioxide from exhaled gas, an exhalation manifold in fluid communication with said breathing bag means through said scrubber, and a multiplicity of breathing stations each between and in fluid communication with said inhalation and exhalation manifolds;

means in said breathing conduit loop to determine when the concentration of oxygen in the gas therein falls to a lowest tolerable level;

means to vent from said breathing bag means, upon signal from said determining means, at least a portion of said gas having an oxygen concentration at said lowest tolerable level; and means to replenish the breathing bag means with gas from said source.

2. The respirator system of claim 1 further including powered means associated with said scrubber to assist movement of exhaled gas through said scrubber, thereby to reduce the amount of effort a user must expend in breathing.

3. The respirator system of claim 2 wherein said assist means comprises a gas-moving means within said breathing conduit loop and adjacent to said scrubber, a bypass conduit within said breathing conduit loop and bypassing said scrubber and gas-moving means, and check valve means within said bypass conduit preventing exhaled gas from bypassing said scrubber in a downstream direction but allowing upstream flow in said bypass conduit.

4. The respirator system of claim 1 wherein said single breathing bag means comprises first and second alternately active compliant breathing bags within a vented chamber of substantially fixed volume, each of said bags having a filled volume of sufficient extent within said chamber such that the replenishing of one bag causes physical interaction thereof with the other bag whereby said other bag is at least partially deflated.

5. The respirator system of claim 4 further having means to alternately activate one of said bags for breathing, said venting means including means to vent the other bag as said activated bag is replenished, and said replenishing means including means to open said source to fill said activated bag with a quantity of oxygen-rich gas from said source.

6. The respirator system of claim 5 wherein said quantity of said gas from said source filled into said activated bag is less than said filled volume.

7. The respirator system of claim 6 further including means to assist movement of exhaled gas through said scrubber.

8. The respirator system of claim 7 wherein said assist means comprises a gas-moving means within said breathing conduit loop and adjacent to said scrubber, a bypass conduit within said breathing conduit loop and bypassing said scrubber and gas-moving means, and check-valve means within said bypass conduit preventing exhaled gas from bypassing said scrubber in a downstream direction but allowing upstream flow in said bypass conduit.

* * * * *